US008847835B2

(12) United States Patent
Kühne et al.

(10) Patent No.: US 8,847,835 B2
(45) Date of Patent: Sep. 30, 2014

(54) RADAR ANTENNA ARRANGEMENT

(75) Inventors: Lutz Kühne, Kronberg im Taunus (DE); Markus Wintermantel, Lindau (DE)

(73) Assignee: Conti Temic Microelectronic GmbH, Nuremberg (DE)

( * ) Notice: Subject to any disclaimer, the term of this patent is extended or adjusted under 35 U.S.C. 154(b) by 2266 days.

(21) Appl. No.: 11/664,636

(22) PCT Filed: Oct. 7, 2005

(86) PCT No.: PCT/DE2005/001796

§ 371 (c)(1),
(2), (4) Date: Feb. 22, 2012

(87) PCT Pub. No.: WO2006/039896

PCT Pub. Date: Apr. 20, 2006

(65) Prior Publication Data

US 2012/0200465 A1 Aug. 9, 2012

(30) Foreign Application Priority Data

Oct. 11, 2004 (DE) ..... 10 2004 049 626

(51) Int. Cl.

| | |
|---|---|
| ***H01Q 3/00*** | (2006.01) |
| ***H01Q 13/00*** | (2006.01) |
| ***H01Q 3/12*** | (2006.01) |
| ***H01Q 3/44*** | (2006.01) |
| ***H01Q 13/28*** | (2006.01) |
| ***H01Q 1/32*** | (2006.01) |

(52) U.S. Cl.

CPC ..... *H01Q 13/28* (2013.01); *H01Q 3/12* (2013.01); *H01Q 3/44* (2013.01); *H01Q 1/3233* (2013.01)

USPC ..... 343/757; 343/781 P; 343/781 R

(58) Field of Classification Search

USPC ..... 343/772, 781 R, 781 P, 783, 786, 780, 343/785

See application file for complete search history.

(56) References Cited

U.S. PATENT DOCUMENTS

| | | | | |
|---|---|---|---|---|
| 3,810,185 | A * | 5/1974 | Wilkinson | 343/756 |
| 5,572,228 | A * | 11/1996 | Manasson et al. | 343/785 |
| 5,933,120 | A | 8/1999 | Manasson et al. | |
| 6,211,836 | B1 * | 4/2001 | Manasson et al. | 343/785 |
| 6,404,399 | B1 * | 6/2002 | Morita | 343/761 |
| 2003/0095074 | A1 | 5/2003 | Scorer et al. | |

FOREIGN PATENT DOCUMENTS

| | | |
|---|---|---|
| DE | 198 48 722 | 8/1999 |
| EP | 12 51 586 | 4/2002 |

(Continued)

*Primary Examiner* — Hoang V Nguyen
*Assistant Examiner* — Patrick Holecek

(57) ABSTRACT

A radar antenna arrangement, in particular for motor vehicles, is presented, having of a longitudinal waveguide, into which electromagnetic waves are coupled in such a manner that they expand in the longitudinal direction (X) of the waveguide, and an interference structure (12) with a plurality of metallic sections, whereby the interference structure in proximity to the waveguide, at a distance from the waveguide in a first transverse direction (Y) to the waveguide, is arranged at least approximately parallel to the longitudinal direction (X) of the waveguide, so that the interference structure effects an adjusted radiation of the radar waves. The waveguide comprises in the longitudinal direction two metallic surfaces (31, 41) and between these, a dielectric medium (32, 42), whereby the surfaces (31, 41) run in a second transverse direction (Z), which stands both vertically to the first transverse direction (Y) and to the longitudinal direction (X) of the waveguide. Preferably, the interference structure (12) is designed as a rotatable drum with metallic sections which are changed on the circumference and a reflector arrangement is provided for bundling and polarizing the waves.

14 Claims, 2 Drawing Sheets

(56) References Cited

FOREIGN PATENT DOCUMENTS

| | | |
|---|---|---|
| FR | 2839206 | 10/2003 |
| WO | 87/01243 | 2/1987 |
| WO | 02/19466 | 3/2002 |
| WO | 04/001446 | 12/2003 |
| WO | 2005/031921 | 4/2005 |

* cited by examiner

RADAR ANTENNA ARRANGEMENT

BACKGROUND OF THE INVENTION

The present invention relates to a radar antenna arrangement for radar sensors for motor vehicles, which enable a rotation of the antenna characteristics.

A leaky wave antenna arrangement is known from U.S. Pat. No. 5,572,228 and U.S. Pat. No. 621,186, which is realised as a mechanically rotating antenna, whereby it enables a surface-structured drum to be rotated in immediate proximity to a dielectric waveguide. Here, the surface structure of the drum in U.S. Pat. No. 557,228 is structured from individual metal strips, the distance of which changes when the drum is rotated in the area of the dielectric waveguide. As a result, a rotation angle-dependent power decoupling is produced via a so-called leaky wave from the dielectric waveguide. The decoupled power is in each case distributed in the area in the form of irradiation which can be described by an adjusted antenna characteristic, which is referred to below as the lobe, the maximum intensity of which is thus dependant on the respective angle of rotation of the drum. The polarisation of the radiated wave is here oriented in parallel with the metal strips which are present on the drum.

An alternative embodiment of the drum is described in U.S. Pat. No. 621,186. There, the surface structure is formed from individual rows of elements such as elevations and indentations in the drum, with appropriately selected dimensions with reference to their length and width. As a result of a corresponding design, a targeted influencing of the polarisation plane of the radiated lobes is possible. However, due to the structure with individual rows of elements on the drum, a discrete rotation of the lobe results, whereby in contrast, the above-mentioned embodiment also enables a continuous rotation.

The basic principle of the dielectric waveguide which is disturbed by a variable, structured surface for the purpose of radiating a leak wave has already been disclosed in WO 87/01243.

Alongside the above-mentioned restrictions with regard to polarisation and, in the second case, discrete rotation, the dielectric waveguide contained in the arrangement represents a particular difficulty with respect to the practical realisation of the antenna, which must at least be arranged to a high degree of precision (also under ambient influences such as temperature and vibration) over certain lengths, in such a manner that it is freely suspended in immediate proximity to the drum.

In the orthogonal plane to the plane of rotation of the lobe (section plane through the drum and the dielectric guide), a very broad characteristic of the lobe furthermore results due to the geometry of the dielectric guide, which must be bundled by an additional reflector and/or microwave lens. This produces a highly excessive size of the entire antenna arrangement which unacceptable in particular for motor vehicle applications.

The object of the present invention is to provide a radar antenna arrangement which is suitable for use in a radar sensor for motor vehicle applications.

SUMMARY OF THE INVENTION

The radar sensor arrangement should preferably enable in a simple manner and at an acceptable cost a continuous or discrete rotation of one or more lobes, in each case in a plurality of directions, and thus be suitable for use in a cost-effective, high performance radar system, in particular, a radar system for motor vehicle applications.

This object is achieved by a radar antenna arrangement consisting of at least one longitudinal waveguide into which electromagnetic waves are coupled in such a manner that they expand in the longitudinal direction (X) of the waveguide an interference structure (12) with a plurality of metallic sections, whereby the interference structure in proximity to the waveguide at a distance from the waveguide in a first transverse direction (Y) to the waveguide is arranged at least approximately parallel to the longitudinal direction (X) of the waveguide, in such a manner that the interference structure effects an adjusted radiation of radar waves characterised in that the waveguide comprises two metallic surfaces (31,41) and between these, a dielectric medium (32,42), whereby the surfaces (31,41) run in the longitudinal direction and whereby the waveguide is open in a first transverse direction (Y) to the waveguide and the two metallic surfaces (31, 41) are at a distance from each other in a second transverse direction (Z), whereby the second transverse direction stands both vertically to the first transverse direction (Y) and to the longitudinal direction (X) of the waveguide. Advantageous further embodiments are included in the description.

According to the invention, an alternative waveguide type is used, which is arranged in proximity to the interference structure, for example to the above-mentioned surface-structured drum. This waveguide comprises metallic surfaces which are at a distance from each other, between which a dielectric medium is arranged. This dielectric medium may be a gas such as air, as well as solid dielectric media. The electromagnetic wave is coupled between the metallic surfaces in the longitudinal direction. The metallic surfaces run in the longitudinal direction, are open to the first transverse direction to the interference structure and to the side opposite to it, and are arranged facing each other at a distance in the second transverse direction, whereby the second transverse direction is both vertical to the first transverse direction and to the longitudinal direction of the waveguide. This waveguide can advantageously be integrated into a metallic, and thus highly robust base, which makes it possible to reproduce the waveguide in particular with regard to its manufacture, as well as making it resistance to ambient influences. Here, the additional use of dielectric media is possible.

Preferably, the radar antenna arrangement is supplemented by a suitable reflector system for beam bundling in the plane orthogonal to the plane of rotation of the lobe, which enables the smallest possible and very simple structure of the overall antenna arrangements to be achieved. Here, a folded reflector system is advantageously used, consisting of a polariser and reflect array, as has been presented with commonly used exciters (e.g. waveguides or patch antennae) in DE 19848722. As a result of this arrangement, the polarisation plane of the lobe is rotated, which with the overall arrangement described in U.S. Pat. No. 5,572,228 is not possible without additional measures. In addition, reflector systems with a new type of metallization structure are feasible, as described in the non-published PCT/DE 2004/001925. Here, the metallization structure is detuned at variance from a standard, gain-optimised metallization structure, whereby defined metallizations are omitted or are also added, thus influencing the form of the beam.

BRIEF DESCRIPTION OF THE DRAWINGS

Exemplary embodiments of the invention are represented in the drawings, and are explained in greater detail in the description below. In the drawings.

DETAILED DESCRIPTION OF THE DRAWINGS

Figure 1:
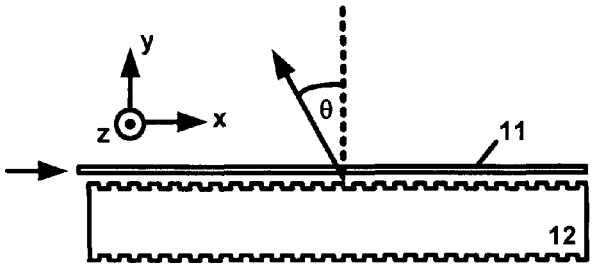
FIG. 1 shows a longitudinal cross-section through the arrangement consisting of a drum and a sample waveguide

FIG. 1 shows a sample waveguide 11 in immediate proximity to a drum 12, which comprises a structured surface. Into this waveguide 11, a power in the high frequency range is fed, which expands along the waveguide 11 in the form of an electromagnetic wave. The surface structure of the drum 12 engages with the electromagnetic fields around the waveguide, and uncouples the power from the arrangement, which is in this manner radiated into the area in the form of a lobe. The direction Θ of the intensity maximum of the lobe results for example with a periodic arrangement of structures on the drum 12 from the correlation $$\sin \Theta = \lambda_0/\lambda_g - \lambda_0/p,$$

whereby $\lambda_0$ represents the free space wavelength, $\lambda_g$ represents the wavelength on the waveguide and p represents the distance between the structures on the drum. Due to the reciprocity theorem, the arrangement operates in an identical manner when receiving.

In the prior art, the waveguide 11 is here designed as a dielectric waveguide with a circular or rectangular profile, surrounded by air. According to the invention, the waveguide 11 is however advantageously, as outlined in FIG. 3, realised as a composite of a metal frame 31 and a dielectric medium 32.

Figure 3:
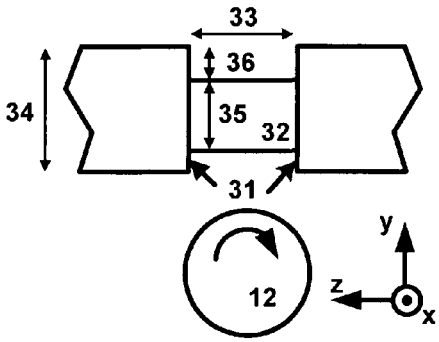
FIG. 3 shows an exemplary embodiment of the waveguide

This waveguide is similar in profile to the H-Guide described in the related literature—however, in contrast to it, with metal walls which are highly restricted with regard to their expansion—which in the present arrangement is operated with a type of parallel plate mode with electric flux lines in a horizontal polarisation with reference to FIG. 3. It is referred to below as the slit guide. The metallic surfaces 31 run in the X direction and are at a distance from each other in the Z direction. Here, the surfaces 31 must not necessarily be flat surfaces, but can for example take the form of rods. The form of a flat surface is however advantageous, in order to affix a solid dielectric medium located between it. The waveguide is open in the Y direction to the interference structure and to the opposite side in which the decoupling is conducted.

The dielectric medium 32 here has a decisive influence on the waveguide and the profile dimensions of the slit guide, which can also be operated in an overmodulated manner for the present antenna function.

Figure 2:
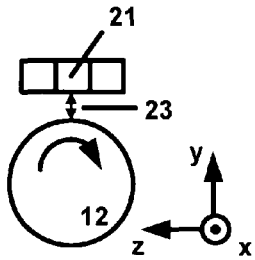
FIG. 2 shows a cross-section through the arrangement consisting of a drum and a sample waveguide

Various forms are possible as a profile for a solid dielectric medium 32; advantageous in terms of practical implementation are rectangular, almost rectangular and hexagonal designs. The strength of the field coupling with the surface of the drum 12 can be set, not only by the distance shown in FIG. 2 between the waveguide 21 and the drum 12, but also by selecting the material of the dielectric medium 32, the profile dimensions of the dielectric medium 32 and the dimensions 33, 34, 35 and 36 with specific limits. In extreme cases, the slit guide in FIG. 3 can also be operated with air as a dielectric medium 32.

Figure 4:
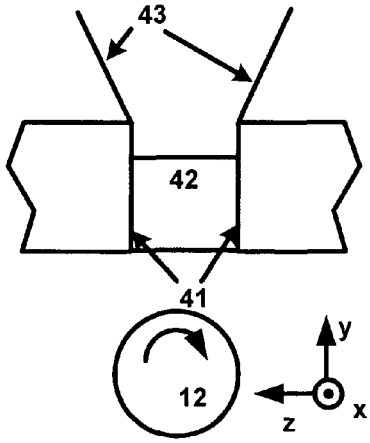
FIG. 4 shows a cross-section of a waveguide with a horn attached for preliminary bundling of the radiated power

An advantageous further embodiment of the slit guide is shown in FIG. 4. The slit guide, consisting of a metallic frame 41 and a dielectric medium 42, here with a sample profile geometry, is also provided with a funnel construction 43, which realises a preliminary bundling of the lobe in the orthogonal plane to the plane of rotation (section plane through the drum and slit guide).

Figure 5:
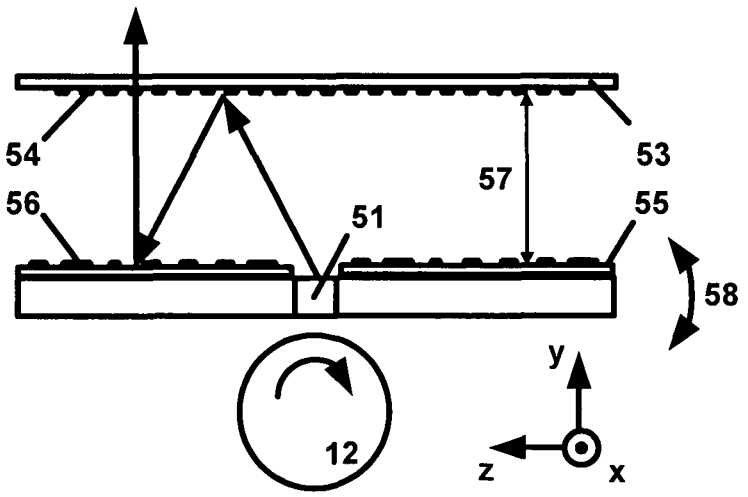
FIG. 5 shows a cross-section of an overall arrangement with a folded reflector system

FIG. 5 shows a profile of an overall antenna arrangement with an additional reflector system, consisting of a subreflector and a main reflector for beam bundling in the level orthogonal to the plane of rotation (section plane through the drum and slit guide).

The lobe, which is decoupled from the waveguide 51 and adjusted by the surface of the drum 12 which is located in the immediate proximity hits a subreflector 53 which acts as a polariser, which is structured from a dielectric material with applied metal grid 54 or metallic strips. The power is fully reflected in this, and is thrown onto a main reflector 55 which is designated as a twist reflector, which is advantageously designed as a reflect array. This also forms or bundles the lobe in the plane orthogonal to the rotational plane of the original lobe using a site-dependent reflection behaviour, while at the same time producing a polarisation rotation of the lobe of 90°, so that the power of the polariser can then pass unimpeded. An essential advantage of this arrangement in contrast to the prior art is that in this manner, a comparatively very compact construction and low overall spatial requirements result. The reflect array here consists for example of a dielectric plate, which has on the side facing the waves which are received a plurality of metallization structures 56, and on the side facing away from the waves which are received, a continuous metallization layer. Here, the dielectric plates of the reflector can be not only flat but also curved. A particularly advantageous design results when the reflect array, alongside the above-mentioned polarisation rotation and forming conducts a further additional forming and/or rotation of the lobe in the plane of rotation of the original lobe. This is possible due to a suitable design of the metallization structures 56 on the dielectric plate.

Figure 6:
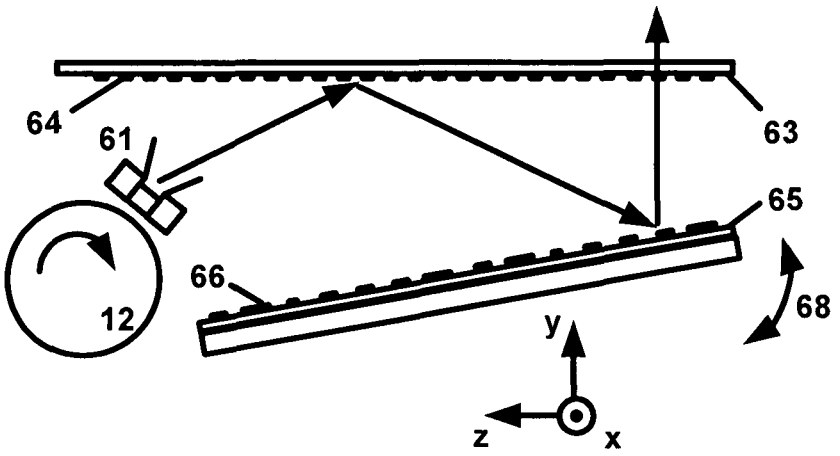
FIG. 6 shows an alternative cross-section with an overall arrangement with a folded reflector system

FIG. 6 shows an alternative profile of an overall antenna arrangement. This slit guide 61 which is provided with a funnel construction near the drum 12 in turn excites a reflector antenna with a subreflector 63 designed as a polariser and a main reflector 65 designed as a twist reflector, in order to achieve the desired additional forming of the lobe in plane orthogonal to the plane of rotation of the original lobe, as described above, and to rotate the plane of polarisation by 90°. The subreflector 63 acts as a polariser, which is structured from a dielectric material with applied metal grid 64 or metallic strips. The main reflector 65 may consist, for example, of a dielectric plate, which has on the side facing the received waves, a plurality of metalization structures 66, and on the side facing away from the received waves, a continuous metallization layer.

An advantageous further embodiment of an overall antenna arrangement as shown for example in FIG. 5 or FIG. 6 consists of the positioning of two or more waveguides in proximity to the drum, which also run at least approximately parallel to the structured surface. In this way, two or more lobes which are independent of each other, which can be used simultaneously and if appropriate, with different forms, are realised with one overall antenna arrangement.

A further advantageous embodiment of an overall antenna arrangement such as that shown in FIG. 5 or FIG. 6 consists of supporting the main reflector 55 or 65 so that it can be rotated, thus enabling an additional mechanical rotation of the lobe by tipping the reflector e.g. in the directions 58 or 68.

In a special embodiment, the main reflector 55 or 65 and/or the subreflector 53 or 63 comprise a bent surface.

The overall antenna arrangements described as examples enable the realisation of a radar system with one or more lobes which are rotated continuously or discretely in the area. Here, the beam width and the realised angle range for the beam rotation can to a large degree be flexibly adjusted due to a suitable design of the surface used for decoupling the power. When a drum surface is used, it is possible, for example, to realise several angle ranges as rotation ranges for the lobes, with different lobe forms in each case.

The invention claimed is:

1. A radar antenna arrangement comprising:

at least one longitudinal waveguide into which electromagnetic waves are coupled in such a manner that the electromagnetic waves expand in a longitudinal direction (X) of the waveguide, wherein the waveguide comprises two metallic surfaces (31,41) and a dielectric medium (32,42) located between the two metallic surfaces, the metallic surfaces (31,41) run in the longitudinal direction and the waveguide is open in a first transverse direction (Y) to the waveguide and the two metallic surfaces (31, 41) are at a distance from each other in a second transverse direction (Z), wherein the second transverse direction stands both vertically to the first transverse direction (Y) and to the longitudinal direction (X) of the waveguide; and an interference structure (12) having a plurality of metallic sections, wherein the interference structure is located in proximity to the waveguide, wherein a central longitudinal axis of the interference structure is at a distance from the waveguide in the first transverse direction (Y) to the waveguide and is arranged approximately parallel to the longitudinal direction (X) of the waveguide, in such a manner that the interference structure effects an adjusted radiation of radar waves.

2. A radar antenna arrangement according to claim 1, wherein the waveguide is a dielectric material (32, 42) with a rectangular or hexagonal profile, framed by metallic plates (31, 41) or rods.

3. A radar antenna arrangement according to claim 1, wherein the waveguide is formed from two metallic plates (31, 41) or rods which are arranged at a certain distance, between which air or another gas is located as a dielectric medium (32, 42).

4. A radar antenna arrangement according to claim 1, wherein on the side of the waveguide facing away from the interference structure (12), a metallic funnel device (43) which opens out from the waveguide is provided.

5. A radar antenna arrangement according to claim 1, wherein a device is provided to change the interference structure (12) by changing the effective metallic sections or their distances from each other.

6. A radar antenna arrangement according to claim 5, wherein the interference structure (12) is designed with a plurality of metallic sections on a drum with a surface structure, such as elevations or indentations, which can be different over the angle of circumference, and the variation of the interference structure (12) is realised by a rotation of the drum.

7. A radar antenna arrangement according to claim 1, wherein the arrangement is used as an exciter for a reflector antenna (53, 55, 63, 65) or a lens antenna.

8. A radar antenna arrangement according to claim 1, wherein the arrangement is used as an exciter of a reflector antenna for polarised waves, which consists of a subreflector (53, 63) which is pervious for waves for a desired polarisation and a main reflector (55,65) for the bundled reflection of the waves with a polarisation rotated in a desired direction.

9. A radar antenna arrangement according to claim 8, wherein the main reflector (55, 65) comprises a dielectric plate, which on a side facing the waves received has a plurality of metallization structures (55, 65) and on a side facing away from the waves received has a continuous metallization layer.

10. A radar antenna arrangement according to claim 8, wherein the subreflector (53, 63) is a dielectric plate with a metallization in the form of a polarisation grid (54, 64).

11. A radar antenna arrangement according to claim 8, wherein one or more reflectors (53, 55, 63, 65) are supported in such a manner that they can be rotated, and can thus be tipped around one or more axes (58, 68).

12. A radar antenna arrangement according to claim 1, wherein a plurality of waveguides are arranged in proximity to the interference structure, which also run at least approximately parallel to the interference structure.

13. A radar antenna arrangement according to claim 1, wherein by varying the interference structure, a rotation of lobes originating from several waveguides is possible in order to cover several angle ranges in the area.

14. A radar antenna arrangement according to claim 1, wherein the radar antenna arrangement is located on a motor vehicle for detecting objects in the area surrounding the motor vehicle.

* * * * *